US006540117B2

(12) United States Patent
Powling

(10) Patent No.: US 6,540,117 B2
(45) Date of Patent: Apr. 1, 2003

(54) DOSING PUMP FOR LIQUID DISPENSERS

(75) Inventor: David J. Powling, East Grinstead (GB)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/821,835

(22) Filed: Mar. 30, 2001

(65) Prior Publication Data

US 2002/0139816 A1 Oct. 3, 2002

(51) Int. Cl.[7] ..... B67D 88/54
(52) U.S. Cl. ..... 222/341; 222/181.2
(58) Field of Search ..... 222/181.2, 341, 222/383.1, 514, 518

(56) References Cited

U.S. PATENT DOCUMENTS

| | | | |
|---|---|---|---|
| 2,545,988 | A | 3/1951 | Bobrick |
| 2,605,021 | A | 7/1952 | Churchill et al. |
| 3,721,370 | A | 3/1973 | Blum |
| 3,952,918 | A | 4/1976 | Poitras et al. |
| 3,955,715 | A | 5/1976 | Topor |
| 4,018,363 | A | 4/1977 | Cassia |
| 4,036,406 | A | 7/1977 | Jespersen et al. |
| D246,338 | S | 11/1977 | Jespersen |
| 4,120,619 | A | 10/1978 | Blackband |
| 4,142,651 | A | 3/1979 | Leopoldi et al. |
| 4,159,788 | A | 7/1979 | Doyel |
| 4,164,306 | A | 8/1979 | Perrin |
| D253,441 | S | 11/1979 | Tucker |
| 4,236,655 | A | 12/1980 | Humphries |
| 4,248,398 | A | 2/1981 | Doyel |
| 4,330,071 | A | 5/1982 | Ohlson |
| 4,349,133 | A | 9/1982 | Christine |
| 4,360,130 | A | 11/1982 | Nishimura et al. |
| D268,154 | S | 3/1983 | Frassanito |
| 4,394,938 | A | 7/1983 | Frassanito |
| 4,421,254 | A | 12/1983 | Spector |
| 4,470,523 | A | 9/1984 | Spector |
| 4,489,857 | A | 12/1984 | Batlas |
| 4,493,440 | A | 1/1985 | Von Buelow et al. |
| 4,502,617 | A | 3/1985 | Stecker et al. |
| 4,546,904 | A | 10/1985 | Frassanito |

(List continued on next page.)

FOREIGN PATENT DOCUMENTS

| | | | |
|---|---|---|---|
| EP | 0530789 B1 | * | 9/1992 |
| FR | 2653100 | * | 10/1989 |
| WO | 9716107 | * | 5/1997 |
| WO | 9809732 | * | 3/1998 |

OTHER PUBLICATIONS

U. S. application Ser. No. 09/741,570, filed Dec. 19, 2000.*
U. S. application Ser. No. 09/741,497, filed Dec. 19, 2001.*

*Primary Examiner*—Lesley D. Morris
*Assistant Examiner*—M. A. Cartagena
(74) *Attorney, Agent, or Firm*—Dority & Manning

(57) ABSTRACT

A dispenser for dispensing metered amounts of a viscous liquid includes a liquid reservoir and a pump chamber having an opening in communication with the reservoir. A dispensing orifice is defined in the pump chamber. A pump mechanism is configured with the pump chamber and is movable from a rest position to a pressurizing position upon actuation thereof to pressurize liquid within the pump chamber. A check valve mechanism is disposed in the opening. A sealing member is disposed within the pump chamber to seal the dispensing orifice upon an initial movement of the pump mechanism to its pressurizing position. The sealing member is moveable within the pump chamber upon subsequent further movement of the pump mechanism to its pressurizing position to unseal the dispensing orifice. Upon initial return movement of the pump mechanism to its rest position, the sealing member remains unsealed relative to the dispensing orifice as a partial vacuum is drawn in the pump chamber and then moves to seal the dispensing orifice upon further subsequent movement of the pump mechanism to its rest position.

24 Claims, 6 Drawing Sheets

U.S. PATENT DOCUMENTS

| | | | |
|---|---|---|---|
| 4,561,571 | A | 12/1985 | Chen |
| 4,570,833 | A | 2/1986 | Vanderjagt |
| 4,573,612 | A | 3/1986 | Maddison et al. |
| 4,621,749 | A | 11/1986 | Kanfer |
| 4,646,945 | A | 3/1987 | Steiner et al. |
| 4,650,095 | A | 3/1987 | Tella et al. |
| 4,660,747 | A | 4/1987 | Borg et al. |
| 4,662,195 | A | 5/1987 | Von Buelow et al. |
| 4,673,109 | A | 6/1987 | Cassia |
| 4,679,709 | A | 7/1987 | Poitras et al. |
| 4,705,195 | A | 11/1987 | Heck |
| D299,399 | S | 1/1989 | Lippman |
| 4,805,814 | A | 2/1989 | Allen, Sr. |
| 4,811,870 | A | 3/1989 | Bianco |
| 4,834,269 | A | 5/1989 | Cone |
| 4,886,192 | A | 12/1989 | Cassia |
| 4,895,276 | A | 1/1990 | Maldonado |
| 4,949,877 | A | 8/1990 | Hanna et al. |
| 4,964,544 | A | 10/1990 | Hanna et al. |
| D312,184 | S | 11/1990 | De Luca et al. |
| 4,972,973 | A | 11/1990 | Davis |
| 4,972,978 | A | 11/1990 | DeLuca |
| 4,974,753 | A | 12/1990 | Tucker et al. |
| 4,978,036 | A | 12/1990 | Burd |
| 4,993,600 | A | 2/1991 | Tucker et al. |
| 5,042,691 | A | 8/1991 | Maldonado |
| 5,044,900 | A | 9/1991 | Cavallaro |
| D321,453 | S | 11/1991 | Ophardt |
| 5,131,568 | A | 7/1992 | Ringuette |
| 5,154,328 | A | 10/1992 | Gueret |
| 5,165,577 | A | 11/1992 | Ophardt |
| 5,174,476 | A | 12/1992 | Steiner et al. |
| D332,544 | S | 1/1993 | Steiner et al. |
| 5,178,300 | A | 1/1993 | Haviv et al. |
| 5,183,182 | A | 2/1993 | Comstock et al. |
| 5,186,368 | A | 2/1993 | Garcia |
| 5,190,191 | A | 3/1993 | Reyman |
| 5,209,377 | A | 5/1993 | Steiner et al. |
| 5,213,236 | A | 5/1993 | Brown et al. |
| 5,217,147 | A | 6/1993 | Kaufman |
| 5,261,557 | A | 11/1993 | Bytell et al. |
| 5,265,772 | A | 11/1993 | Bartasevich et al. |
| D342,176 | S | 12/1993 | Steiner et al. |
| 5,275,309 | A | 1/1994 | Baron et al. |
| 5,282,552 | A | 2/1994 | Ophardt |
| D345,664 | S | 4/1994 | Brandenburg |
| D345,877 | S | 4/1994 | Brandenburg |
| 5,303,851 | A | 4/1994 | Libit et al. |
| 5,305,916 | A | 4/1994 | Suzuki et al. |
| 5,307,962 | A | 5/1994 | Lin |
| 5,316,135 | A | 5/1994 | Kneer et al. |
| 5,322,198 | A | 6/1994 | Ichikawa |
| D349,827 | S | 8/1994 | Brandenburg |
| 5,339,995 | A | 8/1994 | Brown et al. |
| 5,339,999 | A | 8/1994 | Montesissa |
| D350,665 | S | 9/1994 | Ophardt |
| 5,363,993 | A | 11/1994 | Mascitelli et al. |
| 5,373,970 | A | 12/1994 | Ophardt |
| 5,377,877 | A | 1/1995 | Brown et al. |
| 5,409,144 | A | 4/1995 | Brown |
| 5,413,251 | A | 5/1995 | Adamson |
| D359,408 | S | 6/1995 | Frassanito |
| 5,421,489 | A | 6/1995 | Holzner, Sr. et al. |
| 5,427,279 | A | 6/1995 | Kaufman |
| 5,429,275 | A | 7/1995 | Katz |
| 5,431,309 | A | 7/1995 | Ophardt |
| 5,439,143 | A | 8/1995 | Brown et al. |
| 5,439,144 | A | 8/1995 | Holzner |
| 5,443,236 | A | 8/1995 | Bell et al. |
| 5,452,825 | A | 9/1995 | Comstock et al. |
| 5,464,125 | A | 11/1995 | Daansen |
| 5,489,044 | A | 2/1996 | Ophardt |
| 5,501,372 | A | 3/1996 | Daansen |
| 5,524,793 | A | 6/1996 | O'Neill |
| 5,556,005 | A | 9/1996 | Banks |
| 5,595,324 | A | 1/1997 | Brown et al. |
| 5,597,097 | A | 1/1997 | Morris |
| D378,035 | S | 2/1997 | Ophardt |
| 5,598,952 | A | 2/1997 | Daansen |
| 5,605,256 | A | 2/1997 | Fan |
| 5,632,418 | A | 5/1997 | Brown |
| D379,728 | S | 6/1997 | Simon |
| 5,638,989 | A | 6/1997 | Ophardt et al. |
| 5,649,643 | A | 7/1997 | Ridgeway |
| D383,631 | S | 9/1997 | Wirt et al. |
| 5,667,105 | A | 9/1997 | Hartley et al. |
| 5,676,277 | A | 10/1997 | Ophardt |
| D386,640 | S | 11/1997 | Wirt et al. |
| 5,687,877 | A | 11/1997 | Smolen, Jr. |
| D388,990 | S | 1/1998 | Brandenburg et al. |
| 5,704,522 | A | 1/1998 | Orgeolet et al. |
| D391,431 | S | 3/1998 | Brandenburg et al. |
| 5,725,131 | A | 3/1998 | Bell et al. |
| 5,743,440 | A | 4/1998 | Da Laforcade |
| D395,774 | S | 7/1998 | Phillips et al. |
| 5,779,109 | A | 7/1998 | Gueret |
| 5,799,826 | A | 9/1998 | Brown et al. |
| 5,799,841 | A | 9/1998 | Wirt |
| 5,810,203 | A | 9/1998 | Brennan |
| 5,810,204 | A | 9/1998 | Devlin et al. |
| 5,823,397 | A | 10/1998 | Gil |
| 5,826,755 | A | 10/1998 | Burd |
| 5,829,640 | A | 11/1998 | Hershey et al. |
| 5,839,614 | A | 11/1998 | Brown |
| 5,842,609 | A | 12/1998 | Higgins et al. |
| 5,842,611 | A | 12/1998 | Vivier |
| 5,850,948 | A | 12/1998 | Garcia et al. |
| 5,860,574 | A | 1/1999 | Shaklin et al. |
| 5,862,956 | A | 1/1999 | Brandenburg et al. |
| 5,865,352 | A | 2/1999 | Leary |
| 5,887,762 | A | 3/1999 | Hanna |
| 5,897,031 | A | 4/1999 | Wirt et al. |
| 5,899,363 | A | 5/1999 | Bliss, III et al. |
| 5,908,143 | A | 6/1999 | Crossdale et al. |
| 5,927,561 | A | 7/1999 | Foster et al. |
| 5,927,566 | A | 7/1999 | Mueller |
| 5,927,567 | A | 7/1999 | Filmore |
| 5,944,227 | A | 8/1999 | Schroeder et al. |
| 5,944,234 | A | 8/1999 | Lampe et al. |
| D414,363 | S | 9/1999 | Daansen |
| 5,947,338 | A | 9/1999 | Budsworth et al. |
| 5,971,232 | A | 10/1999 | Rohr et al. |
| 5,975,360 | A | 11/1999 | Ophardt |
| 6,016,936 | A | 1/2000 | Fan |
| 6,026,993 | A | 2/2000 | Sperna Weiland |
| 6,036,058 | A | 3/2000 | Chou |
| 6,070,763 | A | 6/2000 | Gueret |
| 6,076,707 | A | 6/2000 | Feldner |
| 6,089,410 | A | 7/2000 | Ponton |
| 6,089,411 | A | 7/2000 | Baudin et al. |
| 6,112,951 | A | 9/2000 | Mueller |
| 6,112,952 | A | 9/2000 | Hess, III et al. |
| 6,131,773 | A | 10/2000 | Wade et al. |
| 6,131,806 | A | 10/2000 | Hess, III et al. |
| 6,152,330 | A | 11/2000 | Polan |
| 6,186,361 | B1 | 2/2001 | Teetsel, III |
| 6,189,740 | B1 | 2/2001 | Wade et al. |
| 6,193,112 | B1 | 2/2001 | Santagiuliana |
| 6,209,752 | B1 | 4/2001 | Mitchell et al. |
| 6,230,935 | B1 | 5/2001 | Mack et al. |
| 6,234,361 | B1 | 5/2001 | Bloom |

6,237,807 B1 5/2001 Uhl et al.
6,240,979 B1 6/2001 Lorscheidt
6,257,844 B1 7/2001 Stern
6,273,297 B1 8/2001 Schalow et al.
6,273,305 B1 8/2001 Fioravanti et al.
6,279,777 B1 8/2001 Goodin et al.
6,321,943 B1 11/2001 Strickler et al.
6,338,442 B1 1/2002 De Laforcade
6,343,724 B1 2/2002 Ophardt et al.
6,345,734 B2 2/2002 Schalow et al.
6,345,736 B1 2/2002 Berry et al.

* cited by examiner

DOSING PUMP FOR LIQUID DISPENSERS

FIELD OF THE INVENTION

The present invention relates generally to liquid dispensers, and particularly to a dosing pump for a viscous liquid dispenser and a dispenser incorporating such a pump.

BACKGROUND OF THE INVENTION

Viscous liquid dispensers are well known in the art for dispensing any manner of viscous liquid, for example lotions, soap, and the like. The conventional dispensers utilize a wide variety of pumping mechanisms which allow a user to depress or manipulate a pump actuator in order to dispense liquid from the dispenser. Exemplary devices are shown, for example, in U.S. Pat. Nos. 5,810,203; 5,379,919; 5,184,760; and 4,174,056.

Conventional dispensers and pump mechanisms are configured generally for vertical mode operation. In other words, the dispenser stands generally upright with the pumping device configured at the top of the unit. These pump devices are generally vented around the stem of the pump and should a user attempt to use the dispenser in a horizontal mode, the dispenser will, in all likelihood, leak around the pump stem.

An additional problem noted with conventional pumps, particularly lotion or soap dispenser pumps, is that there is a tendency for leakage of residual liquid left in the pump head. Certain types of combination pumps, such as peristaltic pumps common to liquid skin care product dispensers, incorporate a spring and ball check valve system in the discharge area to prevent leaking. However, this type of check valve system is relatively expensive and complicated, and the components may be subject to corrosion and/or sticking when used with certain chemical compositions.

Diaphragm type valves are used in certain applications, for example squeeze actuated bottles of hand lotion, in which the bottle is squeezed by a user to provide the liquid pressure required to open the diaphragm valve. However, with these configurations, there is no discreet control over the amount of liquid dispensed.

Thus, there is a need in the art for a dosing pump that can dispense a metered amount of viscous liquid in a horizontal mode while preventing leakage from around the pump mechanism without complicated check valve devices.

SUMMARY OF THE INVENTION

Objects and advantages of the invention will be set forth in part in the following description, or may be obvious from the description, or may be learned through practice of the invention.

The present invention provides a unique dosing pump that is particularly well suited for viscous liquid dispensers, for example, soap dispensers, lotion dispensers, and the like. The pump may be oriented in a generally horizontal configuration and thus allows greater flexibility as to the design and configuration of a dispenser utilizing the pump.

The pump may be utilized with any manner or shape of dispenser. The dispenser will generally comprise a housing member or members that define a liquid reservoir. The pump includes a pump chamber that is in communication with the liquid reservoir. In one embodiment, the pump chamber may be defined internally of the dispenser housing. For example, the pump chamber may comprise and integrally molded component of the housing. In an alternative embodiment, the pump chamber may be configured on the outside of the reservoir or housing with a channel or passage defining a liquid communication path between the reservoir and the pump chamber. It should be appreciated that any number of configurations may be utilized to define a pump chamber that is in fluid communication with a liquid reservoir.

The pump chamber has a volume that generally defines the metered dose of liquid to be dispensed. A dispensing orifice is defined in the pump chamber. The orifice may be defined in any wall member of the chamber, or in one particular embodiment according to the invention, the orifice is defined in a bottommost wall of the pump chamber.

A pump mechanism is configured with the pump chamber to pressurize liquid within the pump chamber upon actuation of the pump mechanism. The pump mechanism may be any member or configuration of components that pressurizes the liquid contained within the chamber in order to expel or dispense the liquid through the dispensing orifice. In one particular embodiment according to the invention, the pump mechanism includes a pump cylinder that is slidably disposed and retained in the pump chamber. The pump cylinder is moveable from a rest position to a pressurizing position. The cylinder may be biased to the rest position with a spring or other biasing element.

An actuator is configured with the pump cylinder and provides a device for a user to move the pump cylinder to its pressurizing position in order to dispense liquid out the dispensing orifice. The invention is not limited to any particular type of device for actuating the pump. In one particular embodiment, the actuator may comprise a panel member that is pivotally mounted to the dispenser housing. The panel member rests against a front end of a pump cylinder and thus moves the pump cylinder or shaft upon a user depressing the panel member. In an alternate embodiment, the actuator may comprise a plate, button or the like attached directly to the front end of the pump cylinder. The actuator may be configured in any shape to contribute to the aesthetically pleasing look of the dispenser.

A check valve mechanism is operably disposed in the opening between the pump chamber and the liquid reservoir. Upon actuation of the pump, the check valve mechanism moves to seal the pump chamber so that the liquid within the chamber can be pressurized. Upon release of the pump actuator, the check valve mechanism moves to unseal the pump chamber so that a metered amount of viscous liquid is able to flow automatically from the reservoir into the pump chamber for dispensing upon the next subsequent actuation of the pump. The check valve mechanism may take on a number of configurations, such as a ball check valve, a flap member, and the like. In one particular embodiment, the check valve mechanism may comprise an elongated shuttle type valve that is slidable within the opening between the pump chamber and reservoir. The shuttle valve includes a sealing member, such as an elastomeric cap, that seals the opening upon actuation of the pump device. Upon release of the pump, the shuttle valve unseals, and liquid is free to flow past the shuttle valve and into the pump chamber. In the embodiment wherein the shuttle valve includes an elastomeric cap or similar type of sealing member, movement of the pump cylinder back to its rest position causes a slight vacuum to be drawn in the pump chamber before the elastomeric cap unseats. This vacuum is beneficial in that any liquid remaining in the dispensing orifice will be drawn back into the pump chamber.

A sealing member is disposed within the pump chamber to seal the dispensing orifice upon an initial movement of the pump cylinder towards the pressurizing position. For example, in one embodiment the sealing member may remain stationary relative to the pump cylinder and the pump chamber as the pump cylinder is moved initially towards its pressurizing position. In an alternate embodiment, the sealing member may have a longitudinal length so as to move with the initial movement of the pump cylinder while maintaining a seal of the dispensing orifice. As long as the dispensing orifice is sealed by the sealing member and the pump cylinder is moved towards the pressurizing position, liquid within the pump chamber is pressurized.

Upon further movement of the pump cylinder towards the pressurizing position, the sealing member eventually moves and unseals the dispensing orifice. At this point, liquid within the pump chamber will flow out of the dispensing orifice.

Upon initial return movement of the pump cylinder to its rest position, the sealing member remains unsealed relative to said dispensing orifice. So long as the check valve does not immediately unseat, at least a partial vacuum is drawn in the pump chamber causing any liquid in the dispensing orifice to be drawn back into the pump chamber. Upon further movement of the pump cylinder towards its rest position, the sealing member moves to seal the dispensing orifice and, after the check valve has unseated, liquid is drawn from the reservoir past the check valve and into the pump chamber.

This sealing member may be, for example, a multiple lip elastomeric seal disposed circumferentially around the pump cylinder and sealingly engaged against the interior wall of the pump chamber. The sealing member may be moved to seal and unseal the dispensing orifice by engagement members defined on the pump cylinder. For example, a first engagement member may come into contact with and move the sealing member off of the dispensing orifice as the pump cylinder is moved towards the pressurizing position. A second engagement member may come into contact with and move the sealing member over the dispensing orifice as the pump cylinder is subsequently returned to its rest position.

The pump cylinder may include an internal longitudinally extending channel defined therein having an inlet and an outlet. Once the dispensing orifice is unsealed, pressurized liquid within the pump chamber may enter the channel inlet and be dispensed out the channel outlet, the outlet being aligned with the dispensing orifice. In this configuration, the longitudinal channel thus defines a by-pass path for the liquid around the sealing member.

The present invention also includes any manner of dispenser incorporating the unique dosing pump as described herein.

The invention will be described in greater detail below through embodiments illustrated in the figures.

DETAILED DESCRIPTION

Figure 1:
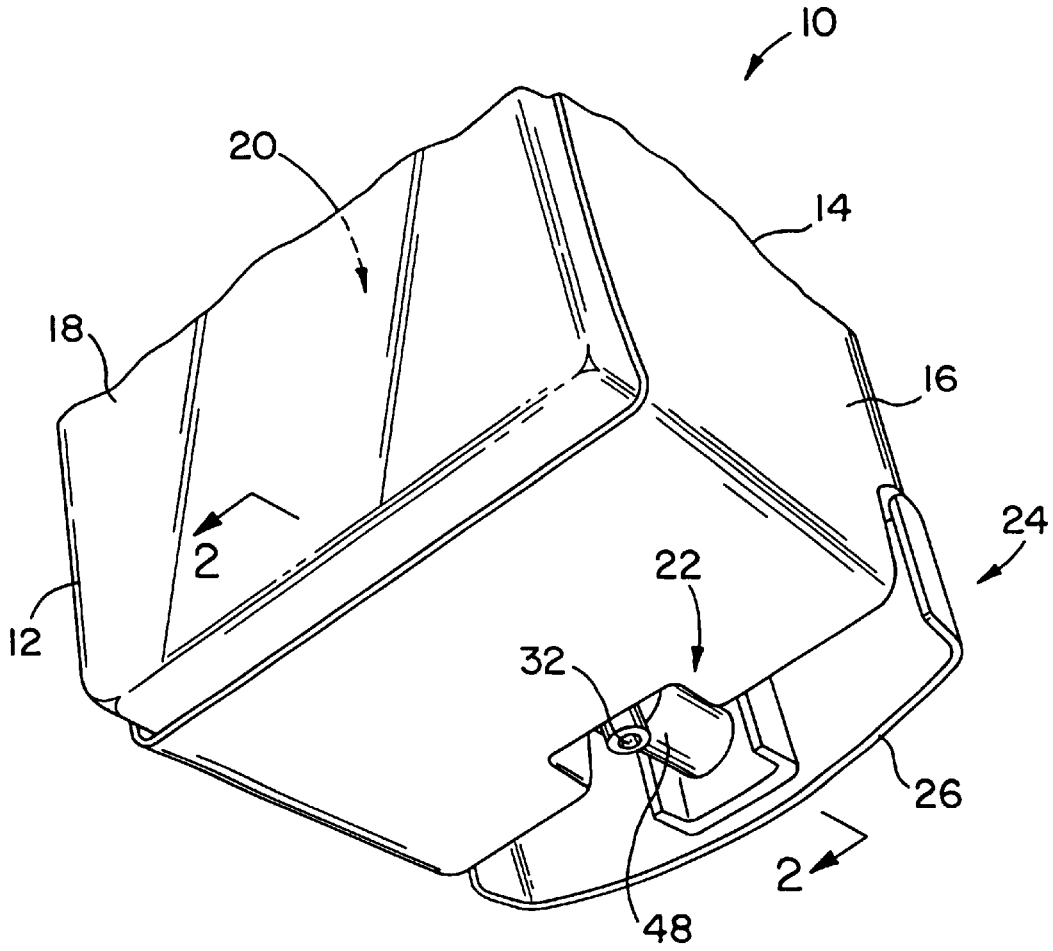
FIG. 1 is a partial prospective view of a viscous liquid dispenser according to the invention.

Reference will now be made in detail to embodiments of the invention, one or more examples of which are provided in the drawings. Each example is provided by way of explanation of the invention and not meant as a limitation of the invention. For example, features illustrated or described as part of one embodiment may be utilized with another embodiment to yield still a further embodiment. It is intended that the present invention include such modifications and variations as come within the scope of the appended claims and their equivalents.

The present invention relates to a unique dosing pump apparatus for use with any manner of liquid dispenser. The pump apparatus is particularly well suited for use with any manner of viscous liquid dispenser, for example soap dispensers, lotion dispenser, and the like. The present invention also encompasses a dispenser utilizing the unique pump apparatus. Such a dispenser is not limited in any way in its point of use or style. For example, a dispenser according to the invention may be used to dispense liquid soap in a public washroom, or may be used to dispense shampoo or soap in residential or commercial bath facilities. All such uses of the dispenser are within the scope and spirit of the invention.

FIG. 1 illustrates a viscous liquid dispenser 10 that is particularly suited as a liquid soap dispenser. The dispenser 10 comprises a housing, generally 14. The housing 14 may comprise any number of components. For example, the housing 14 may include a front housing member 16 that is connected to a back housing member 12 that defines a back surface 18. The dispenser 10 illustrated in FIG. 1 is configured to be removably attached to a wall or other vertical surface. For this purpose, any suitable mounting device or structure may be provided or formed on the back surface 18.

The dispenser 10 includes a liquid reservoir, generally 20. A dosing pump apparatus, generally 22, is configured with the dispenser to dispense metered doses of the viscus liquid contained within the reservoir 20 upon a user depressing or manipulating a pump actuator 24. The pump actuator may be any structural member that is configured with or connected to a pressurizing member of the pump apparatus 22 to dispense the viscus liquid from the dispenser 10. The pump apparatus will be described in greater detail below. In the illustrated embodiments, the pump actuator is illustrated as a panel member 26. The panel member 26 adds to the aesthetically pleasing overall configuration of the dispenser 10 and may take on any shape. The panel member 26 may be pivotally attached to the front housing member 16. Although not illustrated, the actuator 24 may be attached directly to the front of the pressurizing member of the pump apparatus. In this regard, the actuator 24 may comprise any type of plate, button, cap, or like structure that is directly fixed to the pump apparatus.

An embodiment of the dosing pump apparatus 22 is illustrated in FIGS. 2–6. The apparatus 22 includes a pump chamber 30 defined by any manner of structural components. For example, the pump chamber 30 may be defined by wall member or members 34 that are molded or otherwise formed on an internal surface, i.e., a bottom surface, of the housing 14. In this embodiment, the pump chamber 30 is thus disposed completely within the housing 14. In alternate embodiments, the pump chamber 30 may be defined by structural wall members that are attached to the outside surface of the housing member 14 by any conventional means. In either case, the pump chamber 30 is in liquid communication with the reservoir 20. For example, the pump chamber 30 may include a back wall 36 having an opening 38 defined therethrough placing the pump chamber 30 in liquid communication with the reservoir 20. In the illustrated embodiment, the back wall of the pump chamber 30 is defined by an end cap member 40 having the opening 38 defined therethrough. This configuration may be used when it is necessary to insert a pump cylinder (described in greater detail below) into the pump chamber 30 prior to sealing the chamber.

The pump chamber 30 has an internal volume that essentially defines the metered amount or dose of liquid to be dispensed therefrom. In this regard, the pump chamber can be configured with any desired volume depending on the intended use of the dispenser 10.

A dispensing orifice 32 is provided in the pump chamber 30 and defines the exit path for the viscous liquid from the pump chamber. The dispensing orifice 32 may be defined in any structural member of the pump chamber 30. For example, in the illustrated embodiment, the dispensing orifice 32 is defined by a channel in the lower surface of the chamber 30.

As mentioned, the pump apparatus 22 includes a pressurizing mechanism that is operably configured within the pump chamber 30 to pressurize the viscous liquid contained within the pump chamber upon a user actuating the apparatus. Various configurations of devices may be utilized in this regard. For example, in the illustrated embodiment, the pressurizing mechanism is a cylinder member 48 that is slidable longitudinally within the pump chamber 30. The cylinder 48 extends through an opening 46 in a front wall 44 of the pump chamber 30. The cylinder 48 has a front actuating end 52 engaged by the actuator 24. The cylinder may have various configurations. For example, the cylinder 48 may have a first forward section 50, a middle section 56, and an end section 58. A seal ring 54 may be disposed circumferentially around the first section 50 and form a liquid tight seal with the chamber wall 34. The second section 56 has a reduced diameter and defines a longitudinally extending space between the first section 50 and end section 58. The end section 58 includes a flange-like member 60 having passages defined therein so that liquid can flow past the flange member 60 upon movement of the pump cylinder to its pressurizing position. For example, the flange member 60 may comprise an open pattern, such as a star or spoke shape. A cylindrical protrusion 62 may extend rearward from the flange member 60.

The cylinder 48 may have a longitudinal channel 66 defined therethrough, particularly along the second section 56. Channel 66 includes an inlet 68 nearer to the third section 58, and an outlet 70 nearer to the first section 50.

A sealing member is also configured with the pump cylinder 48. In the illustrated embodiment, the sealing member is a ring member 76 having multiple lips 78 that slidably engage against the chamber wall 34. The ring member 76 is disposed around the second section 56 of the cylinder 48. The ring is also slidable relative to the cylinder 48 along the section 56. The ring 76 is made of an elastomeric material and is capable of maintaining a seal against chamber wall 34 while also being able to slide or move longitudinally within the pump chamber 30. The multiple lip configuration of the ring member 76 aids in this regard.

Figure 2:
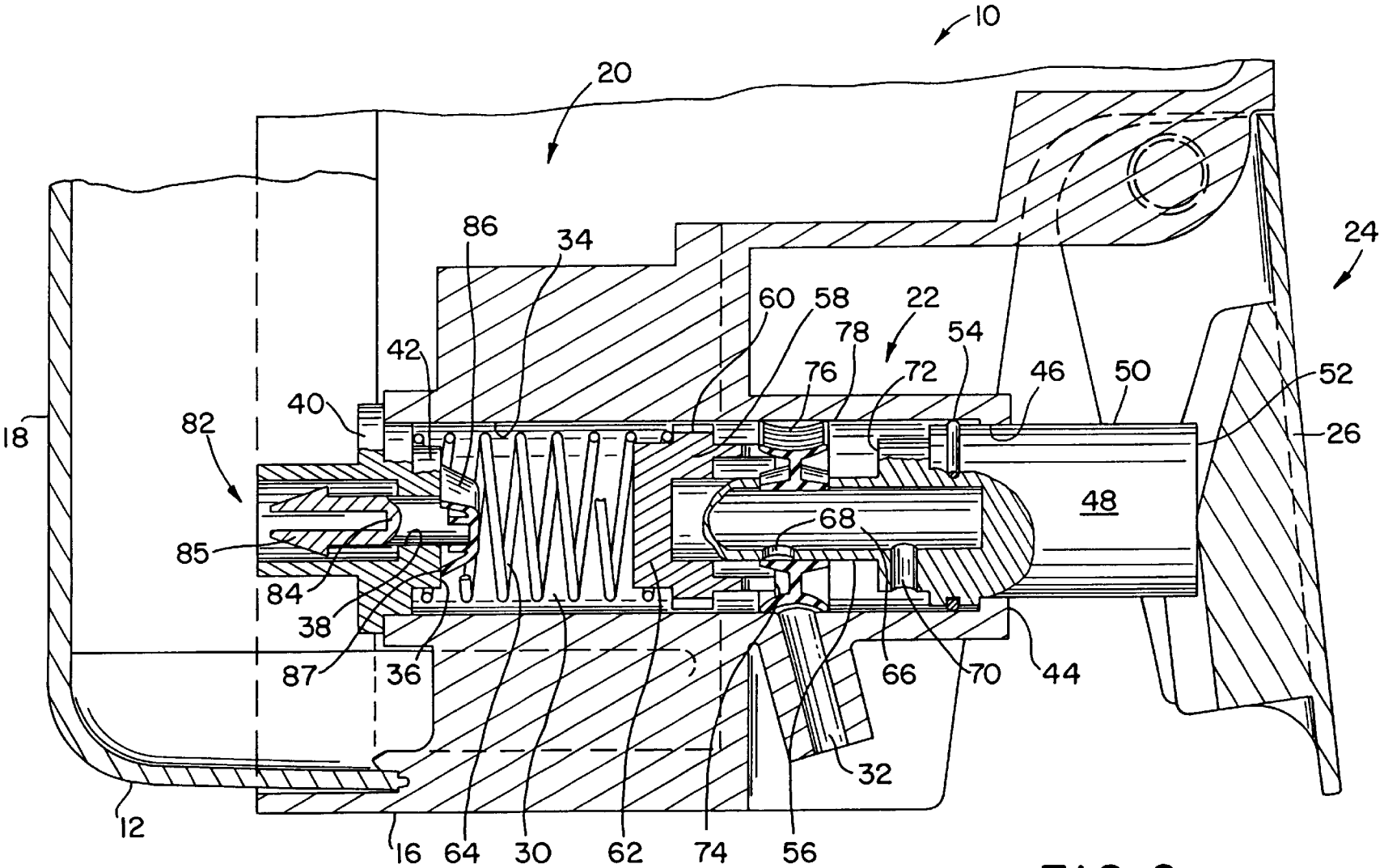
FIG. 2 is a cross sectional view of the pump apparatus taken along the lines indicated in FIG. 1.

A biasing element, such as a spring 64, is disposed within the pump chamber 30 to bias the cylinder 48 to its rest position shown in FIG. 2. The spring 64 is mounted at one end around the protrusion 62 of flange member 60 and at the other end around a protrusion 42 extending from the rear cap member 40.

A check valve mechanism 82 is operably disposed within the opening 38 between the pump chamber 30 and the reservoir 20 to seal the opening upon actuation of the pump mechanism. Various types of check valves may be used in this regard. In the illustrated embodiment, the check valve mechanism 82 is an elongated shuttle valve having a body member 84 slidable within the opening 38 in the cap member 40. The body member 84 has a plurality of spaced apart radially extending arms 85. Liquid from the reservoir 20 is free to flow past the arms 85 and into the pump chamber 30 so long as the shuttle valve 84 is not sealed against the opening 38.

A significant feature of the invention is the "suck-back" capability of the device wherein residual liquid in the dispensing orifice 32 is drawn back into the pump chamber after actuation of the pump mechanism. To enhance this capability, the shuttle valve may include an elastomeric cap 86 that sealingly engages against the back wall 36 of the pump chamber 30 upon actuation of the pump mechanism. The cap 86 may be formed of any suitable elastomeric polymer, such as an elastomeric polyurethane or polyester material. The cap has a particular shape, for example the mushroom shape having a circumferential flange 87 illustrated in the figures, so as to compress and deform slightly as it is pressed against the wall 36, similar to a "plunger" effect. The cap 86 thus seals against the wall 36 to prevent the liquid contained within the reservoir 20 from escaping through the opening 38 and back into the reservoir 20 upon movement of the cylinder 48 from its rest position shown in FIG. 2 to its pressurizing position shown in FIG. 4. As explained in greater detail below, the cap 86 remains sealed against the wall 36 briefly as the cylinder 48 moves from it pressurizing position back to its rest position resulting in a vacuum being drawn in the pump chamber 30. This vacuum causes any residual liquid in the dispensing orifice to be "sucked" back into the pump chamber 30.

Operation of the pump apparatus 24 will now be explained with the aid of the sequential operational FIGS. 2 through 6.

FIG. 2 illustrates the pump apparatus 24 in its rest position awaiting actuation by a user. Liquid from reservoir 20 has entered into the pump chamber 30 through the opening 38 in the back wall of the chamber. The sealing member 76 is positioned so as to seal the dispensing orifice 32. Thus, the liquid in chamber 30 is prevented from leaking out of the chamber.

Figure 3:
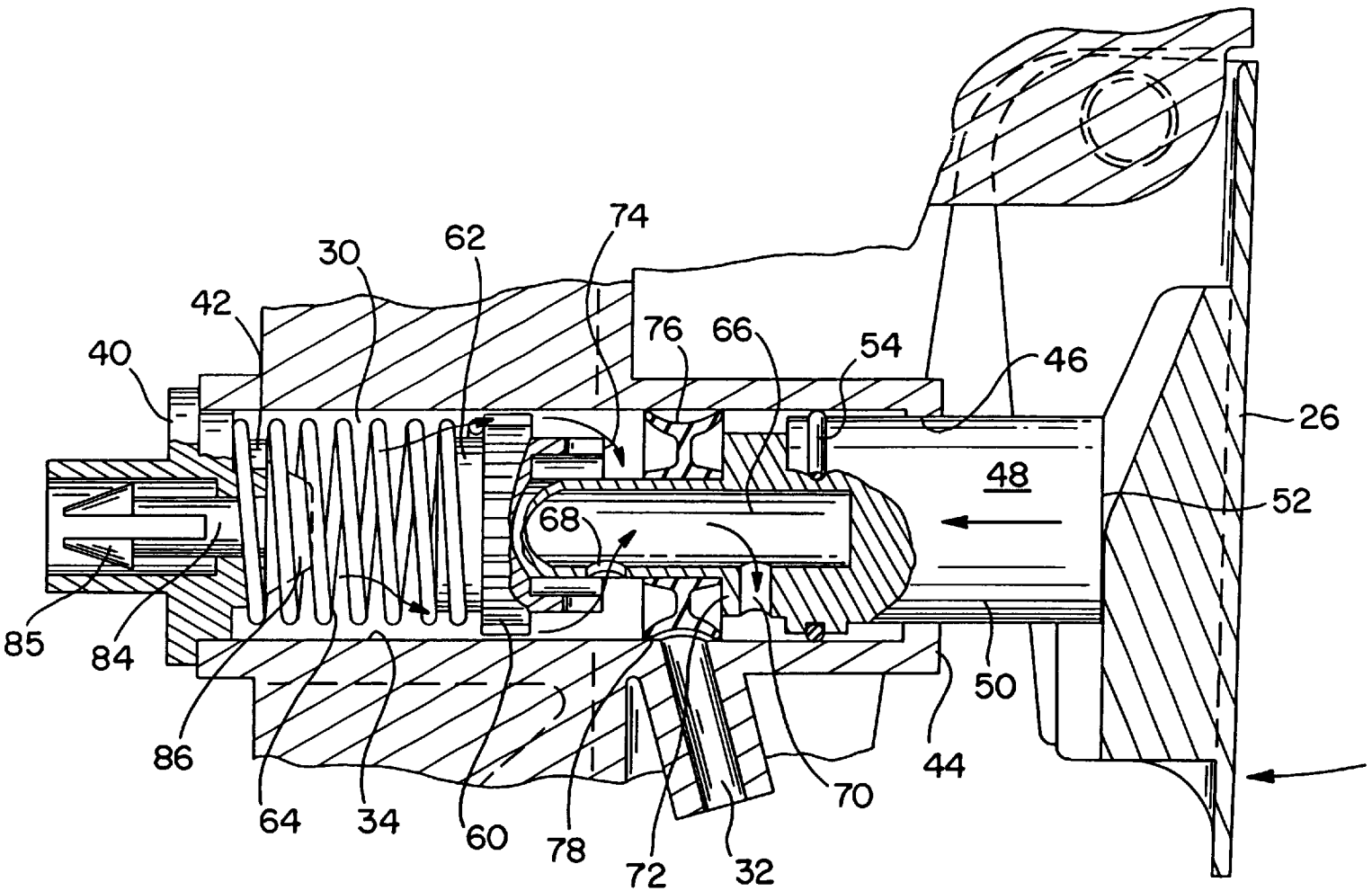
FIG. 3 is a cross sectional operational view of the pump apparatus.

FIG. 3 illustrates the initial position of the actuator panel 26 and cylinder 48 upon a user pressing the panel member 26 to dispense a metered dose of liquid from the dispenser 10. The sealing member 76 remains stationary as the cylinder moves towards the left and continues to seal the dispensing orifice 32 as movement of the cylinder pressurizes the liquid within the chamber 30. The sealing member 76 will remain stationary until engaged by a first engagement member 72 provided on the cylinder 48. The engagement member may be any structural member of the cylinder 48. As the cylinder moves initially towards the left, the check valve body 84 is moved to the left until the elastomeric cap 86 engages and seals against the back wall 36 and the liquid within the chamber 30 is thus pressurized. Under pressure, the liquid within the chamber flows through the inlet 68 of the longitudinal channel 66 within the cylinder 48, and out through the outlet 70. The seal ring 54 thus defines a pressure boundary of the chamber 30 and the channel 66 defines a by-pass around the sealing member 76.

Figure 4:
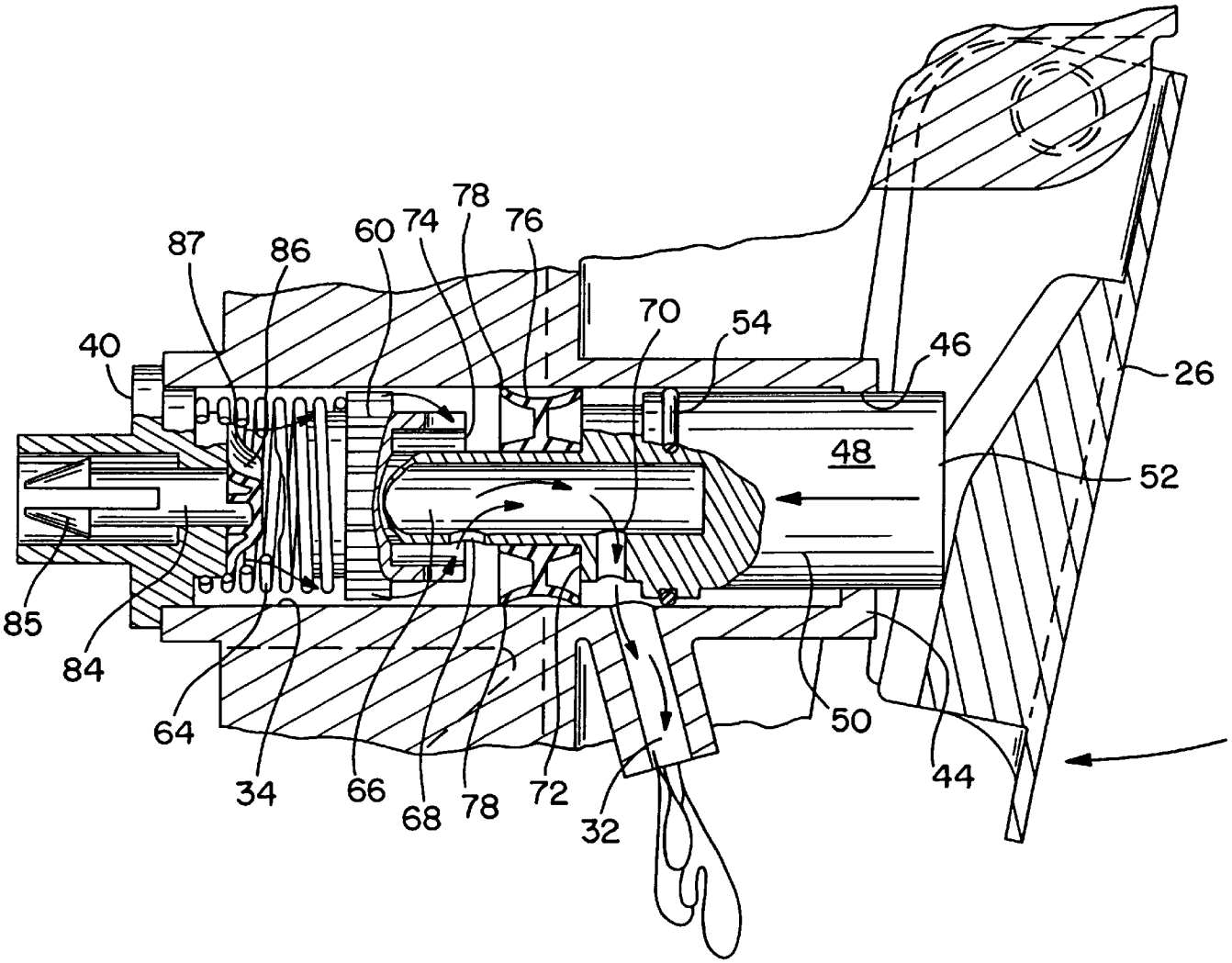
FIG. 4 is a cross sectional operational view of the pump apparatus.

As the cylinder 48 continues to move further towards its pressurizing position, the sealing member 76 is engaged and moved longitudinally within the chamber 30 until the dispensing orifice 32 is uncovered, as seen particularly in FIG. 4. Once the orifice 32 is unsealed, the liquid is free to flow from the chamber 30 out through the orifice 32, as show by the arrows in FIG. 4. The metered amount of liquid within the chamber 30 is thus dispensed from the dispenser 10.

Figure 5:
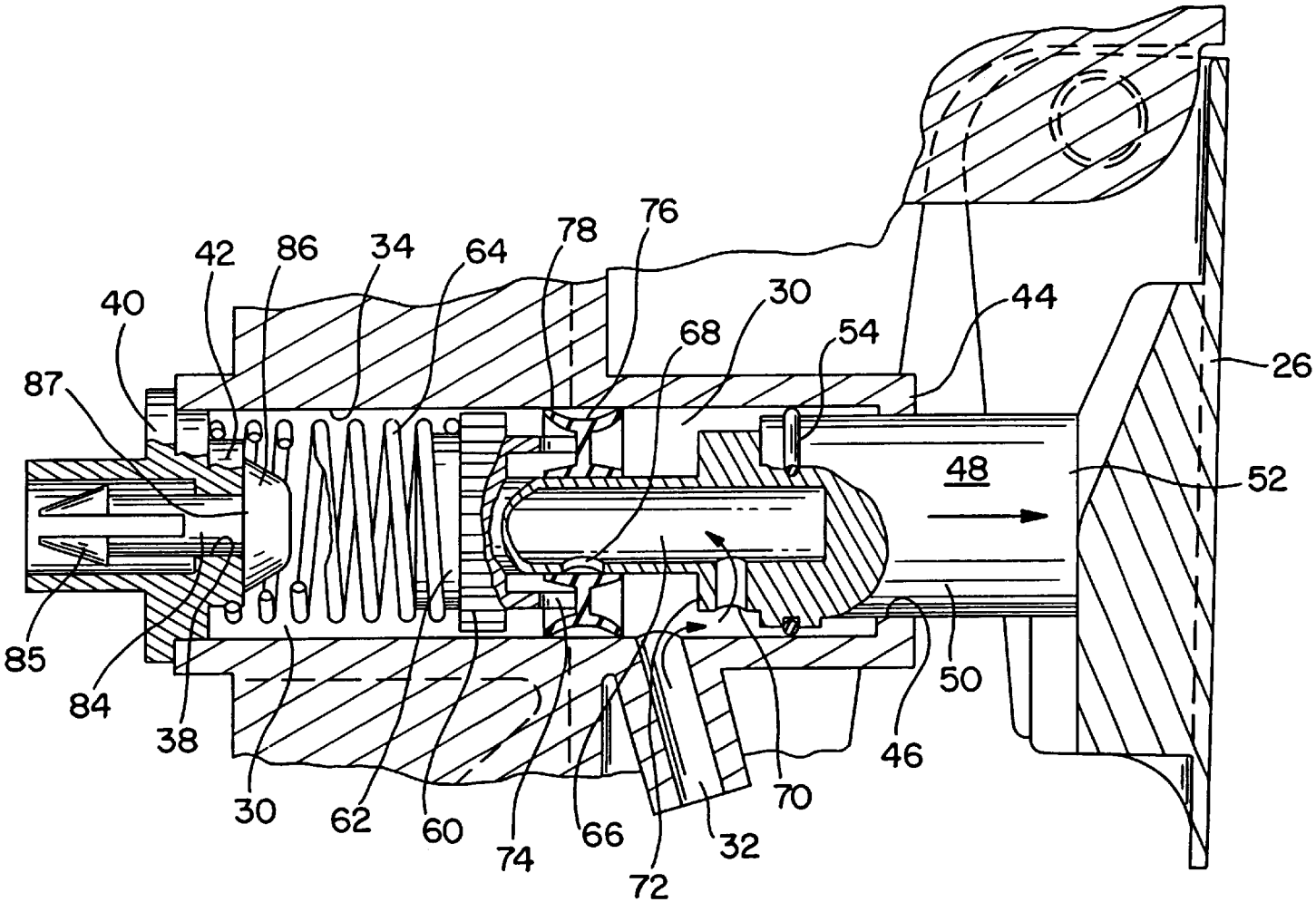
FIG. 5 is a cross sectional operational view of the pump apparatus.

FIG. 5 depicts movement of the cylinder 48 back towards its rest position upon a user releasing the actuating panel 26. The biasing device 64, i.e. a spring, pushes the cylinder towards the right. Meanwhile, the compressed head of the elastomeric cap 86 remains sealed against the back wall 36. This action draws a vacuum within the chamber that sucks any liquid remaining in the dispensing orifice 32 back into the pump chamber 30, as depicted by the arrows in FIG. 5. The elastomeric cap 86 remains sealed against the wall 36 until the vacuum is great enough (in combination with static head pressure of the liquid within the reservoir 20) to unseat the cap 86. At this point, the check valve body 84 moves towards the right and liquid from the reservoir flows past the arms 85, through the opening 38, and into the pump chamber 30.

Figure 6:
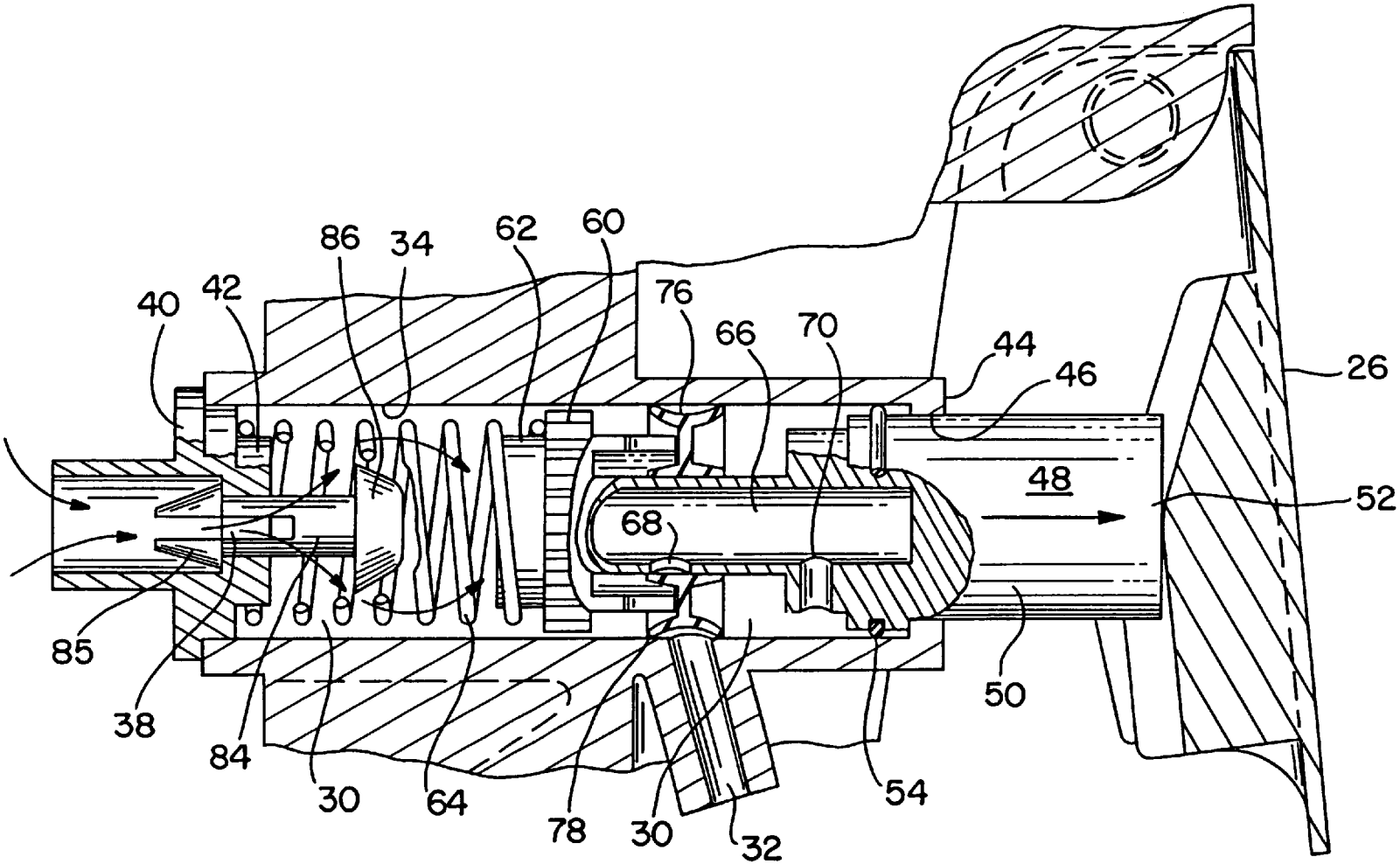
FIG. 6 is a cross sectional operational view of the pump apparatus.

As the cylinder 48 moves back towards its rest position, the sealing member 76 remains stationary until engaged by a second engagement member 74 defined on the cylinder 48. The engagement member 74 may be any structural member of the cylinder 48. The sealing member 76 is engaged and moved by the cylinder so as to move across and seal the dispensing orifice 32 at essentially the same time that the cap 86 unseats from the wall 36, as depicted in FIG. 6. Thus, the liquid drawn into the chamber 30 is prevented from leaking out of the orifice 32 and the chamber is "refilled" with a metered dose of the liquid to be dispensed upon the next actuation of the pump mechanism.

It should be appreciated by those skilled in the art that various modification or variations can be made in the invention without departing from the scope and spirit of the invention. It is intended that the invention include such modifications and variations as come within the scope of the appended claims and their equivalents.

What is claimed is:

1. A dispenser for dispensing metered amounts of a liquid, comprising:

a liquid reservoir, and a pump chamber having an opening in communication with said reservoir;

a dispensing orifice defined in said pump chamber;

a pump mechanism configured at least partially within said pump chamber and movable from a rest position to a pressurizing position to pressurize liquid within said pump chamber;

a check valve mechanism operably disposed in said opening and moveable to seal said opening upon movement of said pump mechanism to said pressurization position, and moveable to unseal said opening upon movement of said pump mechanism to said rest position, said check valve mechanism including an elastomeric cap member that forms a plunger-like seal over said opening upon pressurization of said pump chamber;

a sealing member disposed within said pump chamber to seal said dispensing orifice upon an initial movement of said pump mechanism to said pressurizing position, said sealing member subsequently moveable within said pump chamber upon further movement of said pump mechanism to said pressurizing position to unseal said dispensing orifice; and wherein upon initial return movement of said pump mechanism to said rest position, said sealing member remains unsealed relative to said dispensing orifice as at least a partial vacuum is drawn in said pump chamber and then moves to seal said dispensing orifice upon further subsequent movement of said pump mechanism to said rest position, said elastomeric cap member unsealing from over said opening upon a sufficient vacuum being drawn in said pump chamber.

2. The dispenser as in claim 1, wherein said pump mechanism comprises a pump cylinder slidably disposed and retained in said pump chamber, said pump cylinder further comprising an actuating end extending through a front wall of said pump chamber.

3. The dispenser as in claim 2, further comprising a biasing element disposed to bias said pump cylinder to said rest position.

4. The dispenser as in claim 2, wherein said sealing member is disposed circumferentially around said pump cylinder, said pump cylinder moveable relative to said sealing member along at least a portion of its said initial travel from said rest position to said pressurizing position.

5. The dispenser as in claim 4, wherein said pump cylinder comprises a first engagement member disposed to engage and move said sealing member to unseal said dispensing opening upon said further movement of said pump cylinder to said pressurization position.

6. The dispenser as in claim 5, wherein said pump cylinder further comprises a second engagement member disposed to engage and move said sealing member to seal said dispensing opening upon said movement of said pump cylinder to said rest position.

7. The dispenser as in claim 2, wherein said pump cylinder comprises an internal longitudinally extending dispensing channel defined therein, said dispensing channel further comprising an outlet alignable with said dispensing orifice at said pressurization position of said pump cylinder.

8. The dispenser as in claim 1, wherein said pump chamber is disposed at least partially within said reservoir.

9. The dispenser as in claim 1, further comprising an actuator configured with said pump mechanism, said actuator providing for manual movement of said pump mechanism to operate said dispenser.

10. The dispenser as in claim 9, wherein said actuator is attached directly to a front end of said pump mechanism.

11. The dispenser as in claim 1, wherein said check valve mechanism comprises an elongated shuttle valve slidable within said opening in said pump chamber.

12. The dispenser as in claim 11, wherein said shuttle valve comprises said elastomeric cap member disposed at an end thereof slidable within said opening.

13. A dispenser for dispensing metered amounts of a liquid, comprising:

a liquid reservoir, and a pump chamber having an opening in communication with said reservoir;

a dispensing orifice defined in said pump chamber;

a pump mechanism configured at least partially within said pump chamber and movable from a rest position to a pressurizing position to pressurize liquid within said pump chamber;

a check valve mechanism operably disposed in said opening and moveable to seal said opening upon movement of said pump mechanism to said pressurization position, and moveable to unseal said opening upon movement of said pump mechanism to said rest position, said check valve member comprising an elastomeric cap having a shape so as to at least partially collapse against a wall of said pump chamber defining said opening upon movement of said pump mechanism to said pressurization position; and wherein upon return movement of said pump mechanism to said rest position, said cap initially remains sealed against said wall causing an initial vacuum to be drawn in said pump chamber.

14. The dispenser as in claim 13, wherein said check valve mechanism comprises an elongated body member, said cap disposed at an end of said body member.

15. The dispenser as in claim 13, wherein said cap comprises an elastomeric flange member.

16. The dispenser as in claim 15, wherein said cap is configured generally in a mushroom-like shape.

17. A dosing pump apparatus for dispensing metered amounts of a viscous liquid from a reservoir, said apparatus comprising:

a pump chamber having an opening for receipt of viscous liquid from a reservoir;

a dispensing orifice defined in said pump chamber;

a pump mechanism configured at least partially within said pump chamber and movable from a rest position to a pressurizing position to pressurize viscous liquid within said pump chamber;

a check valve mechanism operably disposed in said opening and moveable to seal said opening upon movement of said pump mechanism to said pressurization position, and moveable to unseal said opening upon movement of said pump mechanism to said rest position, said check valve mechanism including an elastomeric cap member that forms a plunger-like seal over said opening upon pressurization of said pump chamber;

a sealing member disposed within said pump chamber to seal said dispensing orifice upon an initial movement of said pump mechanism to said pressurizing position, said sealing member moveable within said pump chamber upon subsequent further movement of said pump mechanism to said pressurizing position to unseal said dispensing orifice; and wherein upon initial return movement of said pump mechanism to said rest position, said sealing member remains unsealed relative to said dispensing orifice as at least a partial vacuum is drawn in said pump chamber and then moves to seal said dispensing orifice upon further subsequent movement of said pump mechanism to said rest position, said elastomeric cap member unsealing from over said opening upon a sufficient vacuum being drawn in said pump chamber.

18. The pump apparatus as in claim 17, wherein said pump mechanism comprises a pump cylinder slidably disposed and retained in said pump chamber, said pump cylinder further comprising an actuating end extending through a front wall of said pump chamber.

19. The pump apparatus as in claim 18, further comprising a biasing element disposed to bias said pump cylinder to said rest position.

20. The pump apparatus as in claim 18, wherein said sealing member is disposed circumferentially around said pump cylinder, said pump cylinder moveable relative to said sealing member along at least a portion of its travel from said rest position to said pressurizing positive.

21. The pump apparatus as in claim 18, wherein said pump cylinder comprises an internal longitudinally extending dispensing channel defined therein, said dispensing channel further comprising an outlet alignable with said dispensing orifice at said pressurization position of said pump cylinder.

22. The pump apparatus as in claim 17, further comprising an actuator configured with said pump mechanism, said actuator providing for manual movement of said pump mechanism to operate said dispenser.

23. The pump apparatus as in claim 17, wherein said check valve mechanism comprises an elongated shuttle valve slidable within said opening in said pump chamber.

24. A dosing pump apparatus for dispensing metered amounts of a viscous liquid from a reservoir, said apparatus comprising:

a pump chamber having an opening for receipt of viscous liquid from a reservoir;

a dispensing orifice defined in said pump chamber;

a pump mechanism configured at least partially within said pump chamber and movable from a rest position to a pressurizing position to pressurize viscous liquid within said pump chamber;

a check valve mechanism operably disposed in said opening and moveable to seal said opening upon movement of said pump mechanism to said pressurization position, and moveable to unseal said opening upon movement of said pump mechanism to said rest position, said check valve member comprising an elastomeric cap having a shape so as to at least partially collapse against a wall of said pump chamber defining said opening upon movement of said pump mechanism to said pressurization position; and wherein upon return movement of said pump mechanism to said rest position, said cap initially remains sealed against said wall causing an initial vacuum to be drawn in said pump chamber.

* * * * *